United States Patent [19]

Ogawa

[11] 4,209,934

[45] Jul. 1, 1980

[54] MODULAR TOY BUILDING UNITS

[75] Inventor: Iwakichi Ogawa, Kashiwa, Japan

[73] Assignee: Takara Co., Ltd., Tokyo, Japan

[21] Appl. No.: 923,253

[22] Filed: Jul. 10, 1978

[51] Int. Cl.[2] ..... A63H 33/10

[52] U.S. Cl. ..... 46/31; 403/3; 24/213 B; 24/214; 16/150

[58] Field of Search ..... 46/16, 23, 31, 26, 24, 46/29, 30; 35/34, 72; 24/213 B, 213 CS, 214; 403/3, 4; 16/143, 150, DIG. 13

[56] References Cited

U.S. PATENT DOCUMENTS

| | | | |
|---|---|---|---|
| 2,910,737 | 11/1959 | MacMillan | 46/24 X |
| 2,926,941 | 3/1960 | Thompson | 46/29 X |
| 3,274,727 | 9/1966 | Zander | 46/16 |
| 3,488,881 | 1/1970 | Holzer | 46/23 |
| 3,496,670 | 2/1970 | Sloop et al. | 46/26 X |
| 3,597,858 | 8/1971 | Ogsburg et al. | 46/31 X |
| 3,636,230 | 1/1972 | Tacey | 46/31 X |
| 3,827,177 | 8/1974 | Wengel | 46/31 |

FOREIGN PATENT DOCUMENTS

| | | | |
|---|---|---|---|
| 1092418 | 4/1955 | France | 46/23 |
| 1333596 | 9/1962 | France | 16/150 |
| 1403918 | 5/1964 | France | 16/150 |

*Primary Examiner*—Charles E. Phillips
*Attorney, Agent, or Firm*—Jackson, Jones & Price

[57] ABSTRACT

A modular toy building assembly having a plurality of polygonal substantially plate like panel members and a plurality of connecting members is disclosed for forming subjectively determined toy structures. The polygonal panel members can include triangular, rectangular, hexagonal and octagonal members and are provided with a pair of apertures substantially adjacent to each of their side edges. The connecting members can incorporate a living hinge which is capable of a large number of repetitive flexing motions and which divides the connecting member into two portions. A pair of mounting posts which are complimentary to the pairs of apertures in the polygonal panel members, are located on each portion. Dependant on the relative positioning of the connecting members with respect to the panel members, the mounting posts can be press fitted into the apertures and the panel members can be optionally interconnected in a rigid planar or variable angular configuration. The panel members can further be provided with suitable rims and additional apertures for interconnection of various auxiliary structural members such as hemispheric domes, rails and various toy appendages.

19 Claims, 5 Drawing Figures

FIG. 1
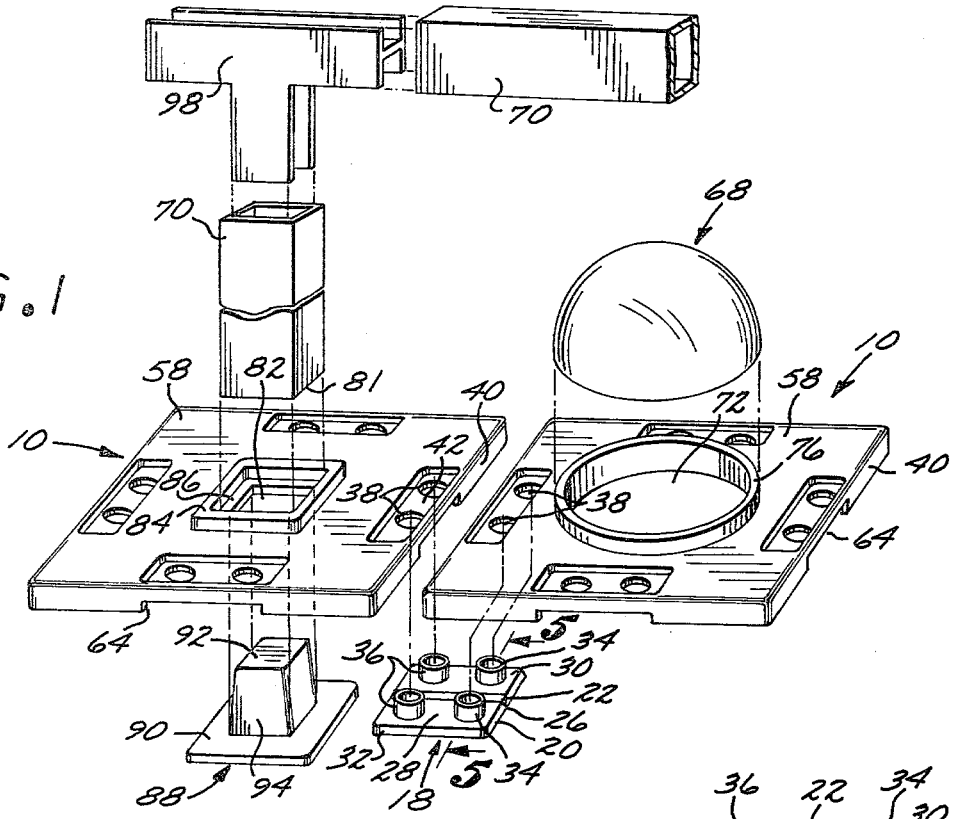
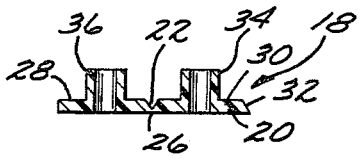
FIG. 5
FIG. 2
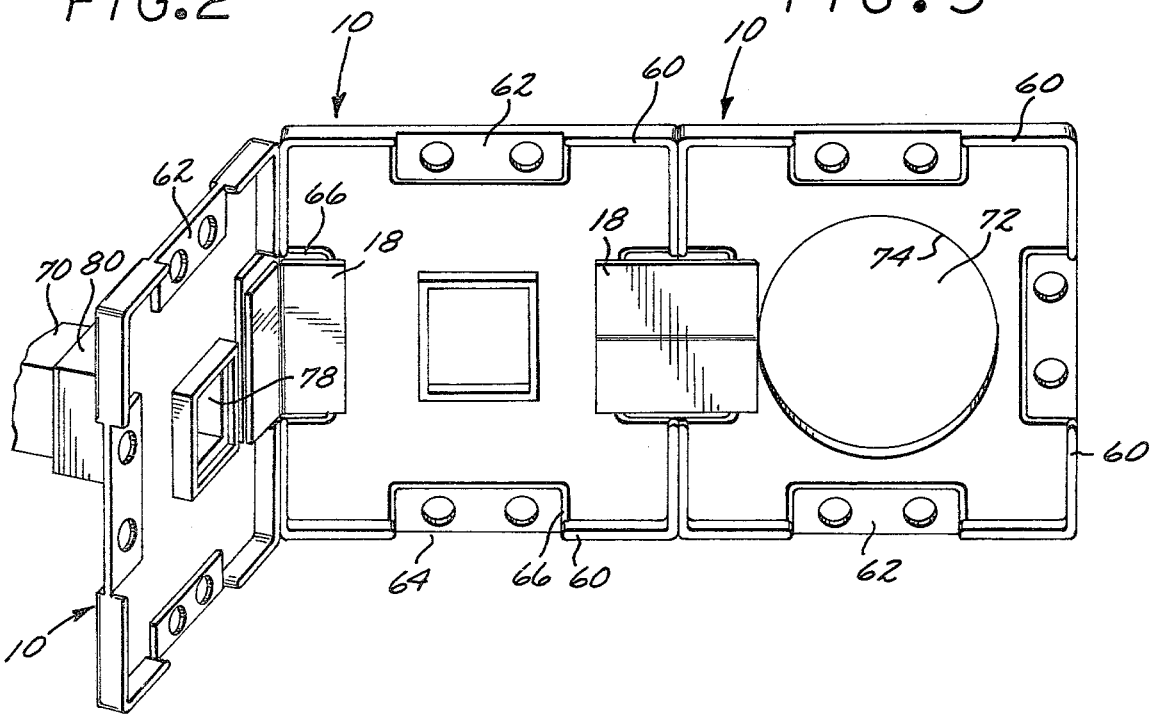

MODULAR TOY BUILDING UNITS

BACKGROUND OF THE INVENTION

1. Field of the Invention

The present invention relates to a modular toy building assembly and more particularly to a modular toy building assembly having individual units capable of being interconnected at a fixed or a variable angular configuration at the option of the user.

2. Description of the Prior Art

The prior art is well aware of the use of modular toy building units. In some modular building assemblies of the prior art, the individual units are interconnected by nuts and bolts or by pegs tightly fitted into apertures in the individual units. In one type of modular building unit of the prior art, the individual pieces are equipped with spaced cylindrical members on one surface of the individual unit, and with likewise spaced matching apertures on another surface of the building unit. Any two individual building units are then joined together by press fitting the cylindrical joining members on one surface of a unit to the matching apertures on the aperture surface of another unit. This latter arrangement however, does not permit a continuously variable angular interconnecting of the units.

Another toy assembly of the prior art has been sold under the trademark Power Blocks. This toy assembly comprised transparent cubes and accessories. The cubes included motors, gear blocks, drive shafts, etc. and could be connected together to form operative toys.

Due to the inherent, everchanging nature of the toy market there is a continuous need to supply toys with novel features which challenge the imagination and the manual dexterity of the children.

SUMMARY OF THE INVENTION

It is an object of the present invention to provide a modular toy assembly, the individual units of which can be joined in a rigid planar configuration or at variable angular configurations at the option of the player to form toy assemblies.

It is another object of the present invention to provide a modular toy assembly having light weight and relatively economically manufactured individual units which can be assembled into a large variety of configurations simulating such toy objects as buildings, space ships, various machines, etc.

It is yet another object of the present invention to provide a modular toy assembly, the assembled units of which provide a storage space in which a user of the toy assembly can place various toy items such as robots.

It is still a further object of the present invention to provide a modular toy assembly which is capable of mounting various other modular toy devices such as operable toy cranes, booms and like appendages.

These and other objects and advantages of the present invention are attained by a modular toy assembly having a number of polygonal panel members and a number of connecting members. The plate like polygonal panel members comprise triangles, rectangles, hexagons and octagons. The panel members are provided with a pair of apertures substantially adjacent to each of its side edges and the apertures are capable of receiving complementary posts provided on the connecting members. The connecting members are made from a suitable plastic material and have two portions, the two portions being separated from each other by a "living" hinge.

The living hinge acts as an axis of rotation between the two portions and allows for a large number of repetitive flexing of the connecting member around the living hinge. A pair of posts are positioned on each portion of the connecting member so as to form a square configuration. When interconnecting two polygonal panel members, the user of the invention has the option of press fitting a pair of posts located on the same side of the living hinge into a panel member and the other pair of posts located on the other side of the living hinge into another panel member thereby interconnecting the two panel members in a variable angular configuration. Alternatively two posts, one of each being located on a different side of the living hinge, may be press fitted into the pair of apertures in one panel member, and the remaining two posts of the same connecting member may be press fitted into the pair of apertures provided on another panel member thereby interconnecting the two panel members in a relatively rigid, planar configuration.

The polygonal panel members are provided with means for interconnecting additional toy appendages such as hemispheres and rails. The interconnection of the hemispherical appendages is accomplished by press fitting the hemisphere, preferrably made from a transparent plastic material, to a rim located substantially in the center of the polygonal panel members. The interconnection of the rail type members may be accomplished by slide fitting a polygonal panel member through an aperture located substantially in the center of the polygonal panel member to the rail. Alternatively, the rails may be connected to the panel members through the utilization of a plug type member which penetrates an aperture in substantially the center of some of the polygonal panel members and which plug is thereafter inserted into the hollow rail.

Other toy appendages, such as an operating crane or boom, may be connected to the same rim portions which are provided on some of the panel members for interconnecting the hemispherical appendages.

The objects and features of the present invention are set forth with particularity in the appended claims. The present invention may be best understood by reference to the following description taken in connection with the accompanying drawings in which like numerals indicate like parts.

BRIEF DESCRIPTION OF THE DRAWINGS

FIG. 1 is a perspective, exploded view of two rectangular panel members that can be interconnected in a straight, planar configuration and having a hemispherical and a rail type appendages;

FIG. 2 is a perspective view of two rectangular panel members interconnected in a straight, planar configuration and of a third rectangular panel member interconnected in a variable angular configuration;

FIG. 5 is a cross sectional view of a connecting member of the present invention.

DESCRIPTION OF THE PREFERRED EMBODIMENT

Figure 3:
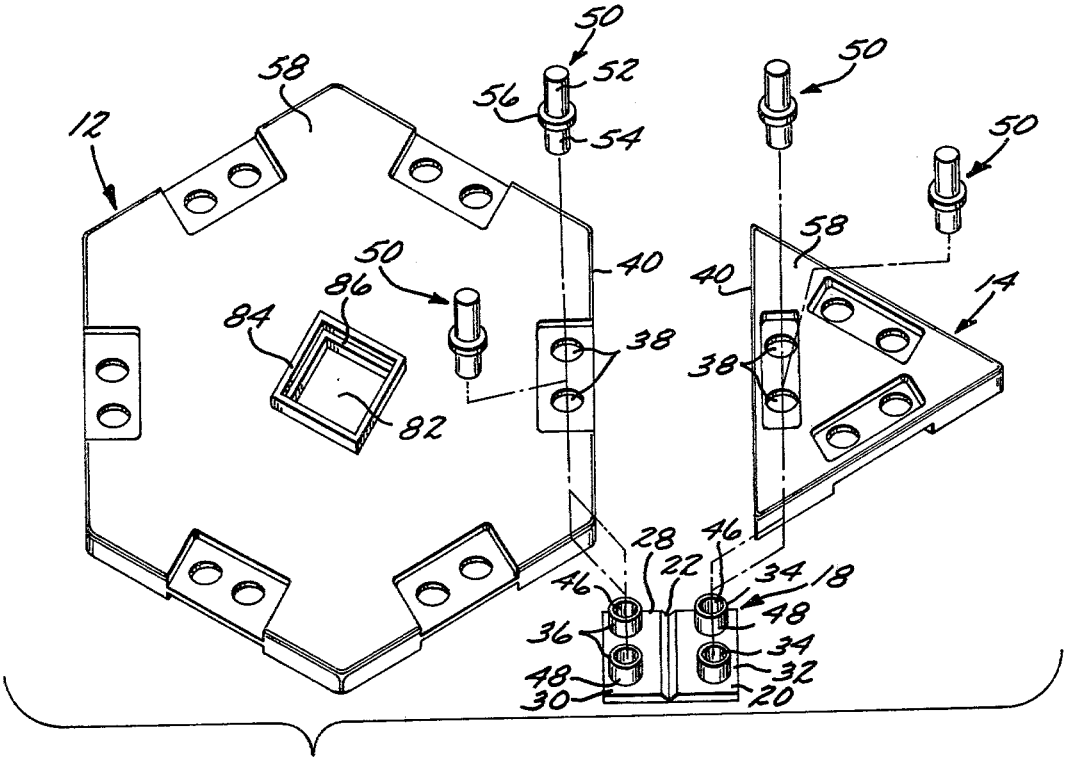
FIG. 3 is a perspective, exploded view of a hexagonal and a triangular panel member interconnected in a configuration allowing for angular variation of the same and having a plurality of locking pegs.

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventor for carrying out his invention in a commercial environment, although it should be understood that various modifications can be accomplished within the parameters of the present invention.

Referring specifically to FIGS. 1, 2, 3, and 4, the polygonal panel members of the present invention are disclosed. As can be seen from FIGS. 1 through 4 each panel member in this preferred embodiment has sides of substantially equal length, and of a dimension compatible with other panel members. Consequently, each panel member can be connected to any other panel member without creating any substantially protruding sides or surfaces in the assembled toy structures. Obviously, other dimensions can be subjectively provided to accomodate any special type of toy design to be assembled.

An embodiment of a connecting member 18 is shown in FIG. 1 for interconnecting two panels together in one of either a planar rigid configuration or angular configurations. The connecting member 18 comprises a base plate 20 separated into two equal portions by a recess or groove 22. In this preferred embodiment, the base plate 20 of the connecting member 18 has a rectangular shape, however other configurations could be provided. The connecting member 18 is conveniently manufactured from a suitable plastic material and a portion of the base plate 20 located underneath the recess or groove 22 comprises a "living" hinge 26. A living hinge, as it is well known in the plastic and toy manufacturing arts, is a neck-down or thin section of plastic material that has a minimal amount of plastic memory or "set" relative to its designed direction of rotation or flexing. The neck-down or thin section of the plastic is relatively free of stresses and is capable of a large number of flexing operations well within the normal life of the plastic article in which it is used. The connecting member 18 having the living hinge 26 is also illustrated in the cross sectional view of FIG. 5.

As it is clearly shown on FIGS. 1 and 3, the living hinge 26 which is disposed across the entire rectangular body of the connecting member 18 separates the connecting member 18 into two equal portions 28 and 30. A pair of cylindrically shaped extensions, hereinafter referred to as posts 34 are located on each portion 28 and 30 of the connecting member 18. The two pairs of posts 34 and 36 spatially form a square configuration.

Referring specifically to FIG. 1, the mode of interconnecting two panel members, such as two rectangular panel members 10 in a relatively rigid, straight planar configuration by the connecting member 18 is disclosed. Each panel member, including the rectangular panel members 10 shown in FIG. 1, are provided with a pair of circular apertures 38 located substantially adjacent to, and substantially in the center of each of its side edges 40. The distance 42 between a pair of apertures 38 correspond in each panel member, to a distance 44 between the pair of posts 34 located on each portion 28 and 30 of the connecting member 18. Because the two pairs of posts 34 and 36 on each connecting member 18 form a square configuration the distance 42 also corresponds to the distance between two posts located on the two portions 28 and 30 of the connecting member 18.

A user of the present invention has the option of joining two panel members in a relatively rigid, straight planar configuration by inserting two posts located on different portions 28 and 30 into a pair of apertures 38 provided in one panel member and the remaining two posts into another pair of apertures 38 located on another panel member, as shown in FIG. 1. The posts 34 are dimensioned to tightly fit within the respective apertures 38 and be removable therefrom only by exertion of a predetermined amount of appropriate force. In this mode of planar interconnection the linear living hinge 26 is disposed perpendicularly to the adjacent side edges 40 of the panel members by virtue of the interconnection by the connecting member 18. Consequently in this mode of interconnection the living hinge 26 is incapable of permitting rotation and the two joined panel members as shown for example in FIG. 1 are rigid in a planar configuration.

While FIGS. 1 and 2 disclose only two panel members interconnected in the above described planar configuration, it is readily apparent that a user of the invention may join a large number of panel members to subjectively create a toy structure. Furthermore the interconnected panel members need not comprise polygons of the same type, for example triangular 14, rectangular 10, hexagonal 12 and octagonal 16 panel members can be joined in a planar configuration in this manner at the subjective choice of the user of the invention.

FIGS. 2 and 3, and in particularity FIG. 3, shows the interconnection of two panel members 12 and 14 in a variable angular configuration by flexing the living hinge 26 incorporated in the connecting member 18. In opting to interconnect two panel members in a variable angular configuration, a user of the present invention inserts the pair of posts 34 and 36 into the respective pairs of apertures 38 in two separate panel members. As the respective pairs of posts 36 and 38 are press fitted into the respective apertures 38 the living hinge 26 is disposed in a position substantially parallel to the side edges 40 of the panel members joined. Consequently the living hinge 26 is capable of acting as an axis of rotation between the two interconnected panel members and the user of the invention has the option of varying the angular configuration of the two interconnected panel members essentially in a range of 0° to 180°.

As mentioned above, the living hinge 26 is constructed to allow a large number of flexing operations and therefore its expected life is well within the design life of the modular toy assembly of the present invention. FIG. 2 shows the interconnection of one rectangular panel member 10 to another rectangular panel member 10 in a variable angular configuration wherein the two interconnected panel members are disposed at essentially a 90° angle.

Figure 4:
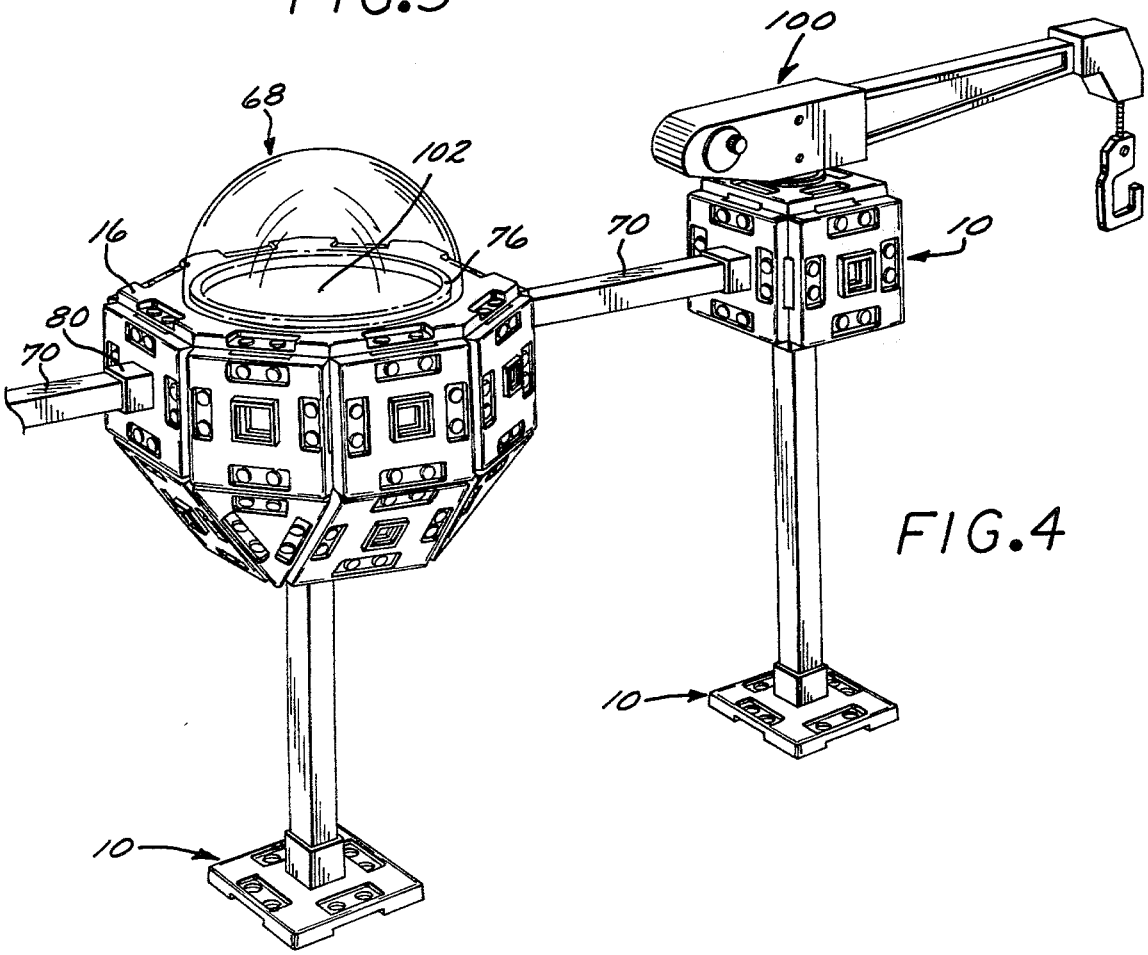
FIG. 4 is an example of a toy assembly built from a plurality of triangular, rectangular and octogonal panel members, a plurality of rails, and a hemispherical appendage, the toy assembly having a toy boom mounted thereto.

FIG. 4 shows a toy structure built from the modular building units of the present invention in accordance to the principles disclosed here and wherein a number of triangular 14, rectangular 10, and octogonal 16 panel members have been interconnected in various angular configuration. The cylindrical posts can optimally incorporate a circular aperture 46, as shown in FIGS. 1, 3, and 5, which extends through the body of the post 48 and through the base plate 20 of the connecting member 18, the longitudinal axis of the aperture 46 being perpendicular to a plane generally defined by the base plate 20 of the connecting member 18.

As illustrated in FIG. 3, a plurality of connecting pegs 50 can form an additional part of this invention. Each connecting peg 50, which is also conveniently manufactured from a suitable plastic material, has a cylindrically shaped upper body 52 and a cylindrically shaped lower body 54. The cylindrically shaped upper 52 and lower 54 bodies are concentrically joined together, and a circular rim 56 is located where the two cylindrically shaped bodies 52 and 54 are joined. The rim 56 is larger in diameter than the upper circular body 52 of the connecting peg 50. The cylindrally shaped lower body 54 is dimensioned to be press fittable into the aperture 46 located in the post, and the length of the lower body 54 is designed to dispose the lower body 54 of the connecting peg 50 substantially flush with a lower surface (not shown) of the connecting member 18 when the connecting peg 50 is inserted into the aperture 46 in the post 34. As the rim 56 is larger in diameter than the aperture 46 it engages the upper surface 57 of the post 34 and thereby prevents further downward motion of the connecting peg into the aperture 46. The upper body 52 of the connecting peg 50 is dimensioned to be slide fittable into any of the apertures 38 provided in the polygonal panel members.

The purpose of providing the apertures 46 in the posts of the connecting members 18 is to allow a user of the present invention to further secure the connecting members 18 to the polygonal panel members by inserting the connecting pegs 50 into the apertures 46 as shown in the perspective view of FIG. 3. Furthermore, since the upper cylindrical body 52 of each connecting peg 50 can be slide fitted into the aperture 38 located in any one of the panel members, the panel members may be stacked upon each other in certain toy structures at the option of the user of the present invention. This can be accomplished by securing the connecting members 18 with the connecting pegs 50 and engaging a number of apertures 38 in the polygonal panel members with the connecting pegs 50.

The perspective view of FIG. 2, discloses a preferred construction of the polygonal panel members of the present invention. In the preferred embodiment, each polygonal panel member regardless of the number of its side edges 40 has a substantially flat base plate 58. In order to lend additional structural strength to the base plate 58, each panel member is provided with a plurality of reinforcing ribs 60 on each side 40 thereof. The reinforcing ribs 60 disposed on the side edges 40 of each panel member totally surround the panel member and thereby provide it with additional strength. Even though the reinforcing ribs 60 are narrow relative to the overall dimension of the polygonal panel members, they are disposed essentially perpendicularly to the general plane defined by the polygonal panel member and increase the overall apparent thickness of the polygonal panel members.

As described above, a pair of apertures 38 is provided adjacent to each side edge 40 of each polygonal panel member. The pair of apertures 38 are disposed in such a manner along the side edges 40 of the polygonal panel members that each aperture is located at a substantially equal distance from a geometric center of the polygonal panel member, furthermore a straight imaginary line interconnecting the centers of each pair of apertures 38 is disposed parallel to the side edge of the polygonal panel member which it is adjacent to. The above geometrical arrangement of the apertures provides a functional as well as a pleasing appearance.

In order to provide the toy assembly of the present invention with additional strength and pleasing appearance, a portion of the polygonal panel member, wherein each pair of apertures 38 is located, is offset from the general plane defined by the polygonal panel member, thus each pair of aperture 38 is located within an offset portion 62. Each offset portion 62 comprises a substantially rectangular plate member having an elongated shape with the general longitudinal axis of the elongated, rectangular offset portion 62 being parallel to the abutting side edge 40 of the polygonal panel member.

Each reinforcing rib 60 on each panel member is provided with one or more notches 64 having the same length as the offset portion 62. The purpose of the notch 64 is to fully accomodate the connecting member 18 when the latter is connected via the posts 34 to the panel member. The notches 64 located in the reinforcing ribs 60 are sufficiently deep so that a mounted connecting member 18 is disposed flush with the lower periphery 66 of the reinforcing ribs 60.

The above described construction of the panel members not only provides for relatively economic manufacture of the invention disclosed here by such relatively inexpensive methods as plastic molding or the like, but also gives an aesthetically pleasing appearance to the polygonal panel members and to the toy devices assembled therefrom.

It is to be noted that various modifications of the specific geometrical construction of the panel members and connecting members may be readily apparent to those skilled in the toy manufacturing arts in light of the present invention, e.g. the apertures 38 and the matching posts 34 may have other than a circular shape and the number of apertures to receive the posts of a connecting member may be other than two. Accordingly such modifications are intended to be within the scope of the present invention.

As apparent from the above description, the polygonal panel members and the variable connecting members of the present invention enable a user of the toy assembly to construct a large number of toy structures such as buildings of various shapes, vehicles, machines, etc. according to the imagination and the pleasure of the user. However, in order to provide the present invention with still further versatility and more play options, the polygonal panel members of the present invention incorporate additional features whereby additional toy appendages such as hemispheric domes 68, rails or beams 70, and various other functional toy devices can be attached to the various toy structures built from the polygonal panel members.

For the above stated reason, some of the polygonal panel members of the present invention incorporate a circular aperture 72 located substantially in the center of the polygonal panel member. The circular aperture 72 is relatively large in relation to the overall size of the polygonal panel member, such as shown in FIG. 1. The circumferential edge 74 of these apertures 72 is substantially adjacent to the rectangular offset portions 62. A circular rim 76 is provided to surround each of the apertures 74 on one side of the respective panel members. The circular rim 76 and the hemispheric domes or hemispheres 68, which are preferrably made from a suitable transparent plastic material, are dimensioned in such a manner that the hemisphere 68 can be readily press fitted onto the rim 76 and is held thereonto by friction.

In order to provide still further play options for the user of the present invention, a plurality of hollow rails or beams 70 having a substantially square cross section are provided. The hollow rails or beams 70 can be conveniently and relatively economically manufactured by extrusion of suitable plastic material. Some of the polygonal panel members are provided with a rectangularly shaped aperture 78 in substantially the center thereof which are dimensioned to slidingly receive the rails 70. In order to prevent any relative movement of a polygonal panel member mounted to a rail 70, the polygonal panel members which have the rectangular apertures 78 also have a hollow channel shaped member 80. The hollow channel shaped members 80 have a substantially square cross section which surrounds the rectangular aperture 78 and extends from the base plate 58 of the panel members, in both directions, perpendicularly to the general plane defined by the base plate 58 of the panel member. On one side of the base plate 58, the hollow channel shaped member 80 which is dimensioned to slide fit onto the rail 70, extends below the base plate 58 of the panel member only as far as the reinforcing ribs 60. On the other side of the base plate 58, the hollow channel shaped member 80 extends a relatively large distance away from the polygonal panel member thereby assuring that the slide fitted rail 70 is relatively firmly mounted to the polygonal panel member and relative movement of the panel member is prevented.

As a still additional feature of the present invention some of the polygonal panel members are provided with means for securing the same to an end 81 of a rail member 70. For this reason, some of the panel members are provided with a rectangular aperture 82 which has, on both sides of the base plate 58, rim type reinforcing members 84 surrounding the rectangular aperture 82. A ledge 86 is formed on the top side of the base plate 58 between the rim type reinforcing member 84 and the aperture 82. The rim reinforcing member 84 and the ledge 86 are dimensioned to receive the end 81 of the rail 70 without allowing the rail 70 to slide through the aperture 82. Thus the ledge 86 supports the end 81 of the rail 70. A plug 88 having a substantially rectangular flange 90 and a preferrably hollow body 92 is dimensioned to slide fit through the aperture 82 and be press fitable within the rail 70. Walls 94 of the plug body 92 are slightly tapered with a wider portion of the plug body 92 abutting the flange 90 so that the strength of the press fitted connection of the plug 88 in the rail 70 is increased.

As illustrated on the perspective exploded view of FIG. 1, the rail 70 is readily assembled to the rectangular panel member 10 by simply positioning the rail 70 on the ledge 86 and press fitting the plug 88 into the rail 70. The plug body 92 and the flange 90 underneath the same is dimensioned in such a manner that in the assembled structure the lower periphery of the flange 90 lies substantially flush with the lower surface 66 of the reinforcing ribs 60 on the panel members. As a consequence, a panel member having a rail mounted thereto can be positioned flat on a planar surface such as a table, and can be utilized as a base support for toy structures built from various units of the present invention as shown on FIG. 4.

FIG. 1 further illustrates a T type connecting member 98 which is utilized for joining the rails 70 in a T configuration when this is desired by the user of the present invention. The T type connecting member 98 is applied by press fitting it into the respective rails 70 to be joined. Other connecting members (not shown) suitable for joining the rails 70 in various other desired configurations such as, e.g. 4 way junctures or angular interconnections, may also be provided with the modular units of the present invention.

In order to provide still further versatility to the modular toy units of the present invention, the circular rims 76 which are capable of mounting the hemispheric domes 68 are dimensioned to be capable of receiving various other toy items. As an example, in FIG. 4 a toy boom 100 is shown mounted to a structure built from the modular building units described in this invention.

A large number of toy structures can be constructed from the various modular units of the present inventions. The structures are relatively light in weight and generally contain cavities or enclosed spaces within the structures. Such a cavity or enclosed space 102 is shown in FIG. 4 and is covered from the top side thereof with a transparent hemispheric dome 68. A child user of the present invention may, at his option, utilize these enclosed but visible spaces for placing therein various toy objects such as robots or dolls thereby increasing the realistic appearance of the toy structures and enhancing the user's pleasure.

What has been described above is a versatile, light weight modular toy building unit assembly which can be utilized for the construction of a large variety of toy devices at the pleasure and option of its user. It will be readily apparent to those skilled in the toy manufacturing arts that various modifications of the present invention are possible and accordingly the scope of the present invention should be interpreted solely from the following claims.

What is claimed is:

1. A modular mountable toy assembly comprising:

a plurality of panel members, each panel member having side edges and at least two apertures located substantially adjacent to each of at least two of its side edges, and a plurality of connecting members, each connecting member having two portions and having two posts fixedly attached to each portion, the posts spatially forming a square configuration, the sides of the square configuration being equal in length to a distance between the two apertures adjacent to the side edges of the panel members, the two posts capable of being press fitted and removably held within the two apertures, each connecting member further including a thin flexible strip interconnecting the two portions and forming an axis of rotation therebetween, whereby a user has the option of interconnecting at least two panel members in a variable, angular configuration by press-fitting the pair of posts located on either portion of the connecting member respectively into the apertures located in one panel member and another panel member, and also option of interconnecting at least two panel members in a relatively rigid, planar configuration by press-fitting two posts, one of each being located on the two different portions of the connecting member respectively into the apertures located in one panel member and another panel member.

2. The invention of claim 1 wherein the panel members include triangular, rectangular, hexagonal and octagonal configurations of predetermined sizes.

3. The invention of claim 1 wherein the toy assembly further comprises a plurality of hemispheres, and wherein some of the panel members have a circular opening, the opening being rimmed by a circular rim, a hemisphere capable of being press-fitted and removably held on the rim.

4. The invention of claim 1 wherein the toy assembly further includes at least one connecting rail, and wherein the panel members include panel members having means for receiving and removably holding the connecting rail.

5. The invention of claim 1 wherein each panel member comprises a substantially flat plate having a plurality of reinforcing ribs, the ribs being located in a plane traverse to a plane substantially defined by the flat plate.

6. The invention of claim 5 wherein the reinforcing ribs rim the outer peripheries of the flat plates of each panel member.

7. The invention of claim 1 wherein each panel member comprises a substantially flat plate having a plurality of offset portions, the apertures being located in the offset portions.

8. The invention of claim 1 further comprising a plurality of connecting pegs and wherein the posts incorporate apertures penetrating through the posts and through the connecting members, the connecting pegs tightly fitting within the apertures in the posts whereby a fastening of the connecting plates to the panel members is reinforced by the insertion of the connecting pegs.

9. A modular mountable toy assembly comprising:

a plurality of panel members, each panel member having a plurality of side edges with adjacent peripheral apertures, and a plurality of connecting members, each connecting member having two portions and at least two mounting posts on each portion, the two portions being separated from each other by a relatively thin flexible part of the connecting member which allows a continuous bending of the connecting member whereby the two portions of the connecting member may be configured at a desired angular configuration relative to one another, the mounting posts located on each portion of each connecting member being spatially configured to engage and frictionally coact with the peripheral apertures on any of the side edges of the panel members, whereby one connecting member may connect two panel members in a continuously variable angular configuration; the mounting posts being further configured so that at least two mounting posts one of which is located on different portions of the connecting member may engage and frictionally coact with the peripheral apertures on any of the side edges of one panel member, and at least two other mounting posts one of which is located on different portions of the connecting member may engage and frictionally coact with the peripheral apertures of another panel member whereby the two panel members may be connected in a rigid planar configuration.

10. The invention of claim 9 further comprising a plurality of hemispheres and wherein the panel members include panel members having means for removable attachment of the hemispheres.

11. The invention of claim 10 wherein the hemispheres are made from a transparent plastic material and wherein the means for removable attachment of the hemispheres comprise a circular rib extending from the panel members upon which the hemispheres are press-fitted.

12. The invention of claim 9 wherein the panel members include panel members having means for removable attachment of a rail.

13. The invention of claim 12 wherein the means for removable attachment of the rail comprise a hollow channel shaped member extending from the panel member into which the rail is slide-fitted.

14. The invention of claim 12 wherein the means for removable attachment of the rail comprise a plug penetrating an aperture provided in the panel member, the plug capable of being press-fitted into the rail.

15. The invention of claim 9 wherein each panel member has offset portions, the apertures in the panel members being located in the offset portions.

16. The invention of claim 9 wherein there are two mounting posts on each portion of each connecting member and the mounting posts of one connecting member spatially form a square configuration.

17. A modular mountable toy assembly comprising:

a plurality of panel members having a plurality of substantially linear side edges with adjacent peripheral apertures, and a plurality of connecting plates, each connecting plate having a substantially linear thin flexible portion which comprises a living hinge, the living hinge separating the connecting plate into a first and a second platelike portion, the first portion having at least two mounting posts attached thereto and the second portion having at least two mounting posts attached thereto, the mounting post of the connecting plate being spatially configured to be capable of frictionally engaging and removably holding the peripheral apertures of two panel members in one of two alternative spatial arrangements, the first spatial arrangement being wherein the linear living hinge is substantially at a right angle to juxtaposed linear side edges of the two panel members, the second spatial arrangement being wherein the linear living hinge is substantially parallel with juxtaposed linear side edges of the two panel members, the first spatial arrangement providing a rigid planar interconnection of the two panel members, and the second spatial arrangement providing a continuously variable angular interconnection of the two panel members.

18. The invention of claim 17 wherein the panel members include triangular, rectangular, hexagonal and octagonal configurations of predetermined sizes.

19. The invention of claim 18 wherein the first platelike portion and the second platelike portion of each connecting plate each have two mounting posts attached thereto and the mounting posts of the first and second portions spatially form a square configuration.

* * * * *